US009074502B2

(12) United States Patent
Valencia

(10) Patent No.: US 9,074,502 B2
(45) Date of Patent: Jul. 7, 2015

(54) POSITIVE CRANKCASE VENTILATION SYSTEM AND METHOD FOR OPERATION

(71) Applicant: Ford Global Technologies, LLC, Dearborn, MI (US)

(72) Inventor: Frank Acierno Valencia, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 68 days.

(21) Appl. No.: 13/945,626

(22) Filed: Jul. 18, 2013

(65) Prior Publication Data

US 2014/0331979 A1 Nov. 13, 2014

Related U.S. Application Data

(60) Provisional application No. 61/821,118, filed on May 8, 2013.

(51) Int. Cl.

| | |
|---|---|
| ***F02M 25/06*** | (2006.01) |
| ***F01M 13/04*** | (2006.01) |
| ***F01M 13/02*** | (2006.01) |
| *F01M 13/00* | (2006.01) |

(52) U.S. Cl.

CPC ..... *F01M 13/04* (2013.01); *F01M 13/028* (2013.01); *F01M 13/023* (2013.01); *F01M 13/0416* (2013.01); *F01M 2013/0005* (2013.01); *F01M 2013/0494* (2013.01)

(58) Field of Classification Search

CPC ..... F01M 13/022; F01M 13/023; F01M 2013/0055; F01M 2013/0038; F01M 13/04; F01M 13/028; F01M 13/00416; F01M 2013/0005; F01M 2013/0494

USPC ..... 123/572–574

See application file for complete search history.

(56) References Cited

U.S. PATENT DOCUMENTS

| | | | | |
|---|---|---|---|---|
| 5,024,203 | A | 6/1991 | Hill | |
| 5,499,616 | A * | 3/1996 | Enright | 123/572 |
| 5,586,996 | A * | 12/1996 | Manookian, Jr. | 55/321 |
| 6,123,061 | A | 9/2000 | Baker et al. | |
| 6,405,721 | B1 * | 6/2002 | Moren | 123/572 |
| 6,435,170 | B1 | 8/2002 | Hamelink et al. | |
| 7,047,955 | B2 | 5/2006 | Ookawa et al. | |
| 7,775,198 | B2 | 8/2010 | Shieh | |
| 2002/0078936 | A1 * | 6/2002 | Shureb | 123/572 |
| 2002/0083934 | A1 * | 7/2002 | Ruehlow et al. | 123/573 |
| 2010/0101514 | A1 | 4/2010 | Hirano et al. | |
| 2010/0269803 | A1 * | 10/2010 | Iwata | 123/572 |
| 2012/0247438 | A1 | 10/2012 | Konohara | |

FOREIGN PATENT DOCUMENTS

| | | | |
|---|---|---|---|
| EP | 2182185 | A1 | 5/2010 |

* cited by examiner

*Primary Examiner* — Marguerite McMahon

(74) *Attorney, Agent, or Firm* — Julia Voutyras; Alleman Hall McCoy Russell & Tuttle LLP

(57) ABSTRACT

A positive crankcase ventilation (PCV) system is provided. The PCV system includes an oil return line coupled to a PCV oil separator and extending through a crankcase housing and a PCV bypass valve positioned in a wall of the oil return line, the PCV bypass valve opening when a pressure in the crankcase exceeds a threshold value and closing when a pressure in the crankcase falls below a threshold value.

20 Claims, 6 Drawing Sheets

POSITIVE CRANKCASE VENTILATION SYSTEM AND METHOD FOR OPERATION

CROSS REFERENCE TO RELATED APPLICATION

The present application claims the benefit of and priority to U.S. Provisional Patent Application No. 61/821,118, filed May 8, 2013, the content of which is incorporated herein by reference for all purposes.

BACKGROUND/SUMMARY

Positive crankcase ventilation (PCV) systems are provided in engines to reduce emission as well as to decrease the amount of oil leakage from the engine. PCV systems typically seal the crankcase and provide air flow therethrough via a pressure differential in the intake system such as in intake conduits upstream and downstream of a throttle. Therefore in some PCV systems, air is drawn into the crankcase via a port positioned upstream of the throttle and released from the crankcase in a port positioned downstream of the throttle.

European Patent (EP) 2182185 discloses a crankcase ventilation system in an engine providing circulation of air through a crankcase. However, the Inventors have recognized several drawbacks with the crankcase ventilation system disclosed in EP 2182185. For example, the crankcase ventilation system disclosed in EP 2182185 may malfunction, causing the pressure in the crankcase to rise. The malfunction may be brought about by freezing of the oil in the PCV lines caused by a drop in temperature. The PCV malfunction may also be caused by production tolerances and/or assembly variability of components in the PCV system, giving rise to increased crankcase pressure. The elevated pressure in the crankcase may lead to component degradation.

As such, in one approach, a PCV system is provided. The PCV system includes an oil return line coupled to a PCV oil separator and extending through a crankcase housing and a PCV bypass valve positioned in a wall of the oil return line, the PCV bypass valve opening when a pressure in the crankcase exceeds a threshold value and closing when a pressure in the crankcase falls below a threshold value. The PCV bypass valve decreases the likelihood of the crankcase as well as other sealed chambers in the PCV system from reaching undesirable pressures which may damage components in the engine and PCV system. Moreover, the integration of the PCV bypass valve into the wall of the oil return line increases the compactness of the PCV system and the engine, if desired. Therefore, it will be appreciated that the technical results achieved via the PCV system include increasing the system's compactness and decreasing the likelihood of component degradation.

Further in one example, the oil return line is coupled to an oil separator that is in fluidic communication with an intake conduit. The intake conduit may be upstream or downstream of a throttle. Therefore, when the PCV bypass valve is open gas flows through the oil return line through the oil separator and then to the intake conduit. In this way, crankcase gases release through the PCV bypass valve may be internally routed back to the intake system, further increasing the PCV system's compactness.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventor herein, and are not admitted to be known.

BRIEF DESCRIPTION OF FIGURES

FIGS. 2-8 are drawn to scale, although other relative dimensions may be used.

DETAILED DESCRIPTION

The present description relates to a positive crankcase ventilation (PCV) system having a bypass valve integrated into an oil return line. The oil return line may be coupled to an oil separator which is in fluidic communication with an intake conduit. The bypass valve is configured to open and close based on the pressure in a sealed crankcase chamber. As a result, the likelihood of component damage caused by an over-pressurized crankcase is reduced. Furthermore, the integration of the PCV bypass valve into the wall of the oil return line decreases the profile of the PCV system. As a result, the compactness of the engine may be increased, if desired. In one example, the bypass valve is a passively operated valve, thereby reducing the complexity of the system and therefore the likelihood of system malfunction.

Figure 1:
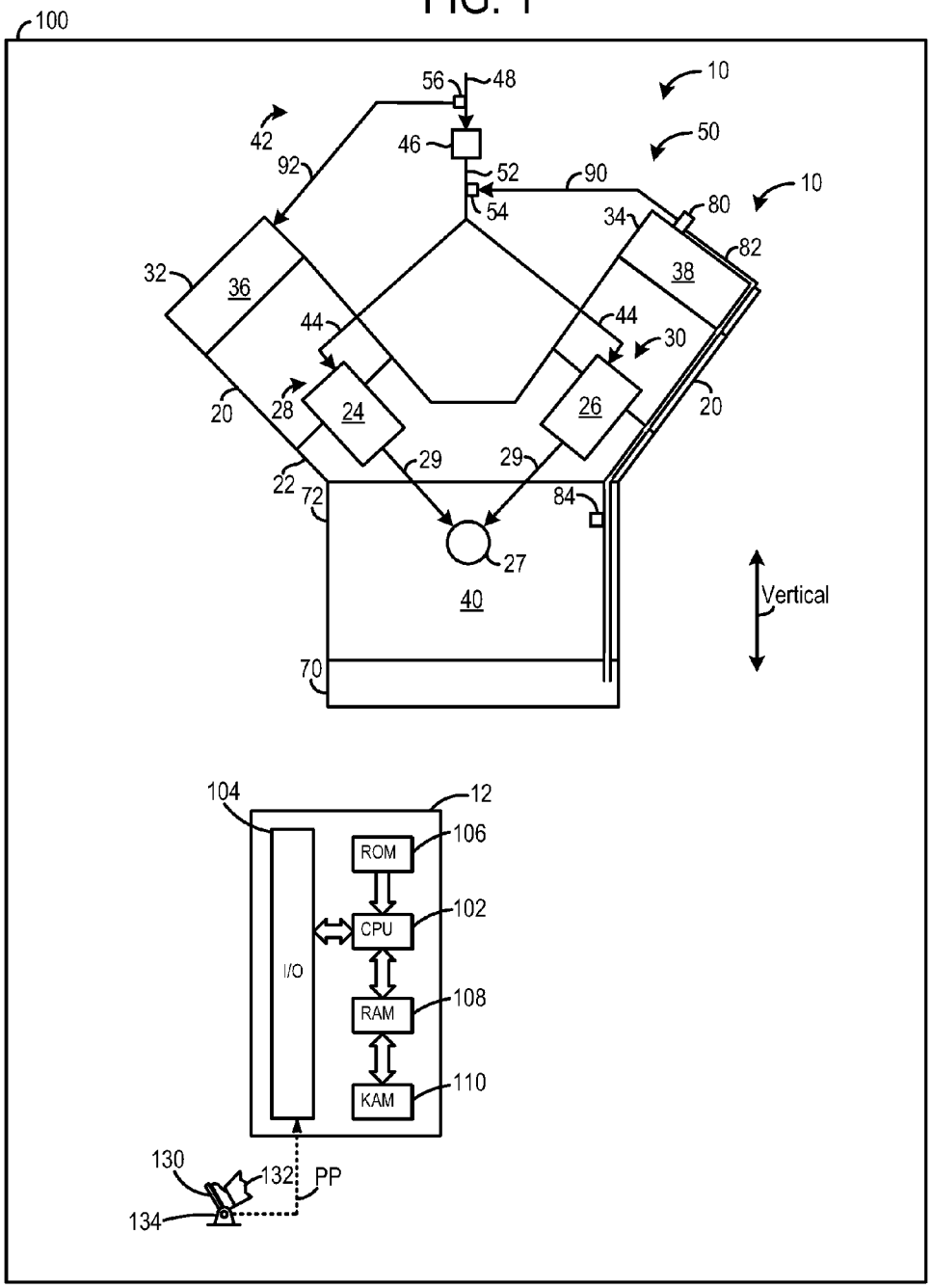
FIG. 1 shows a schematic depiction of an engine including a positive crankcase ventilation (PCV) system.

FIG. 1 shows an illustration of an engine 10 including a PCV system 50. The engine 10 may be included in a vehicle 100. Thus, the engine 10 may provide motive power to one or more wheels in the vehicle 100.

FIG. 1 shows a schematic diagram of an engine 10 included in a propulsion system of a vehicle 100. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

The engine 10 includes a cylinder head 20 coupled to a cylinder block 22 forming cylinders (24 and 26). Each of the cylinders (24 and 26) of engine 10 may include combustion chamber walls (not shown) with a piston (not shown) positioned therein. It will be appreciated that the cylinders may be referred to as combustion chambers. Pistons in the cylinders (24 and 26) are mechanically coupled to a crankshaft 27 via piston rods or other suitable components, denoted via arrows 29. As shown, the engine 10 includes a first cylinder bank 28 and a second cylinder bank 30. The first cylinder bank 28 includes one or more cylinder(s) (e.g., cylinder 24) arranged at a non-straight angle with regard to one or more cylinder(s) (e.g., cylinder 26) in the second cylinder bank 30. A first cylinder head cover 32 (e.g., cam cover) is coupled to a portion of the cylinder head 20 forming a portion of the first cylinder bank 28. A second cylinder head cover 34 (e.g., cam cover) is coupled to a portion of the cylinder head 20 forming a portion of the second cylinder bank 30. The engine 10 may include overhead camshafts. However, other camshaft configurations have been contemplated. The first cylinder head cover 32 may serve as a boundary for a cover enclosure 36 (e.g., cam enclosure). Likewise, the second cylinder head cover 34 may serve as a boundary for a cover enclosure 38 (e.g., a cam enclosure). The cover enclosures (36 and 38) are in fluidic communication with a sealed crankcase chamber 40. The cover enclosures and the sealed crankcase chamber 40 are therefore substantially sealed and configured to substantially inhibit external gas flow except at selected ports (54 and 56) or other locations. Sealing the crankcase reduces engine emissions, such as blow-by gases flowing from the combustion chamber into the crankcase chamber past the pistons. Furthermore, sealing the crankcase reduces oil contamination of oil in the oil reservoir and oil leaks from the engine.

The sealed crankcase chamber 40 has a crankshaft 27, piston rods, etc., positioned therein. It will be appreciated that the crankshaft 27 is configured to transfer energy generated in the cylinders to a gear-train in the vehicle, in some examples. The boundary of the sealed crankcase chamber 40 may be defined by an oil reservoir 70 (e.g., oil pan), a crankshaft girdle 72, and the cylinder block 22. The oil reservoir 70 may be coupled to the crankshaft girdle 72. In turn, the crankshaft girdle 72 is coupled to the cylinder block 22. The crankshaft girdle 72 provides support to the cylinder block 22. Additionally, the crankshaft girdle 72 may also partially enclose the crankshaft. Oil or other suitable lubricant may be collected in the oil reservoir 70. Additionally, an oil pump included in a lubrication system may be in fluidic communication with the oil in the oil reservoir.

The cylinders (24 and 26) are configured to receive intake air from an intake system 42, denoted via arrows 44. It will be appreciated that intake valves and exhaust valves may be coupled to the cylinders (24 and 26). The intake valves are configured to cyclically open and close to provide at least intake air to the cylinders. On the other hand, the exhaust valves are configured to cyclically open and close to flow exhaust gas from the cylinders to an exhaust system.

The intake system 42 may further include a throttle 46. The throttle 46 is configured to adjust the airflow through the intake system 42. The throttle may be adjusted via the controller 12. An intake conduit 48, denoted via an arrow, in fluidic communication with the throttle 46 and positioned upstream of the throttle is included in the intake system 42. Additionally, an intake conduit 52, denoted via an arrow, in fluidic communication with the throttle 46 and positioned downstream of the throttle is also included in the intake system. The intake conduit 48 and/or the intake conduit 52 may each define an intake volume. It will be appreciated that during engine operation when cyclical combustion is being performed a pressure in the intake conduit 52 may be less than a pressure in the intake conduit 48.

An outlet port 54 is coupled to the intake conduit 52. The outlet port 54 is coupled to an intake conduit downstream of the throttle 46, in the depicted example. However, in other examples the outlet port 54 may be coupled to an intake conduit upstream of the throttle 46, such as the intake conduit 48. Likewise, an inlet port 56 is coupled to the intake conduit 48. The outlet port 54 and the inlet port 56 are included in the PCV system 50. The outlet port 54 and the inlet port 56 are in fluidic communication with the sealed crankcase chamber 40. The inlet port 56 provides intake air to the crankcase chamber 40, while the outlet port 54 receives gas (e.g., blow-by gas, air, etc.,) from the crankcase chamber. It will be appreciated that the pressure differential between the intake conduit 48 and the intake conduit 52 drives gas circulation through the PCV system 50. Further, it will be appreciated that in other examples, alternative pressure differentials in the intake system may be used to drive air circulation through the crankcase chamber 40 in the PCV system 50. For instance, a jet pump positioned in the intake system 42 may be used to drive gas flow through the PCV system 50.

A PCV line 90, denoted via an arrow, provides fluidic communication between the cover enclosure 38 and the outlet port 54. A PCV line 92, denoted via an arrow, provides fluidic communication between the cover enclosure 36 and the inlet port 56.

As shown, an oil separator 80 is coupled to the PCV line 90. Thus, the oil separator 80 is in fluidic communication with the intake conduit 52. Additionally, the oil separator 80 is also included in the PCV system 50. The oil separator 80 is configured to remove oil from blow-by gasses directed towards the inlet port 56. The oil separator 80 is coupled to the second cylinder head cover 34 in the depicted example. However, other oil separator locations have been contemplated.

An oil return line 82 is coupled to the oil separator 80 and configured to receive oil from the oil separator removed from the blow-by gasses flowing therethrough. The oil return line 82 extends through the second cylinder head cover 34, the cylinder head 20, the cylinder block 22, the crankshaft girdle 72, and the oil reservoir 70. However, in other examples other oil return line 82 routes have been contemplated. Blow-by gas may also be flowed through the oil return line 82 while a PCV bypass valve 84 is open. The PCV bypass valve may be a flapper valve, a Silicone umbrella valve, a ball valve, or metal reed style valve.

The PCV bypass valve 84 is coupled to the oil return line 82. The PCV bypass valve 84 may be a passively operated valve or in some examples an active valve controlled via the controller 12, discussed in greater detail herein. The PCV bypass valve 84 is configured to open and release blow-by gas in the crankcase chamber 40 to the intake system 42 when the crankcase chamber 40 exceeds a threshold valve. Specifically, in one example blow-by gassed may be flowed through the oil return line 82, the oil separator 80, the PCV line 90, and the outlet port 54, into the intake conduit 52 when the PCV bypass valve 84 is open. Likewise, the PCV bypass valve 84 is also configured to close when the crankcase chamber falls below a threshold value. In some examples, the opening and closing threshold values may be substantially equivalent. However in other examples, the opening and closing threshold values may not be equivalent. As shown, the PCV bypass valve 84 is positioned in a wall of the crankshaft girdle 72. The PCV bypass valve 84 may be positioned vertically above the crankshaft 27. Additionally, the PCV bypass valve 84 is positioned below the cylinders (24 and 26). A vertical axis is provided for reference. However, other PCV bypass valve positions have been contemplated. Additionally, the crankshaft girdle 72, the oil reservoir 70, and/or the cylinder block 22 may be included in a crankcase housing.

Controller 12 is shown in FIG. 1 as a microcomputer, including microprocessor unit 102, input/output ports 104, an electronic storage medium for executable programs and calibration values shown as read only memory 106 (e.g., memory chip) in this particular example, random access memory 108, keep alive memory 110, and a data bus. Controller 12 may receive various signals from sensors included in the engine 10 such as an absolute manifold pressure signal, MAP, from sensor 122. It will be appreciated that in other examples the controller 12 may receive signals from additional sensors such as a throttle position sensor, an engine temperature sensor, an engine speed sensor, etc.

During operation, the cylinders (24 and 26) in the engine 10 typically undergo a four stroke cycle: the cycle includes the intake stroke, compression stroke, expansion stroke, and exhaust stroke. It will be appreciated that spark and/or compression ignition may be used to ignite an air/fuel mixture in the cylinders.

Figure 2:
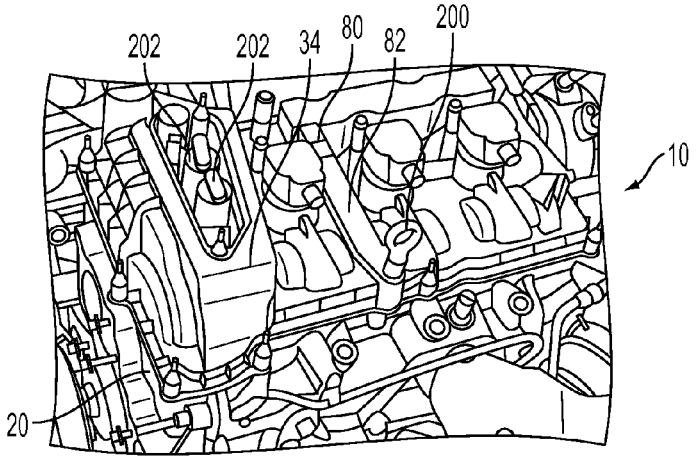
FIGS. 2-3 show different views of an example engine including the PCV system shown in FIG. 1.

FIGS. 2-8 show an example illustration of the engine 10, depicted in FIG. 1. Therefore, similar parts, components, etc., are labeled accordingly. FIG. 2 shows the engine 10 including the second cylinder head cover 34 coupled to the cylinder head 20. The oil separator 80 and oil return line 82 are also shown in FIG. 2. The oil separator 80 is integrated into the second cylinder head cover 34, in the depicted example. Additionally, the oil return line 82 extends through an integrated exhaust manifold 201, thereby increasing the PCV system's compactness. Specifically, the oil return line 82 may be routed through exhaust runners in the integrated exhaust manifold. However, other oil return line routing has been contemplated. An oil level stick 200 (e.g., dip stick) is also shown in FIG. 2. The oil level stick 200 may extend through a portion of the oil return line 82. Cam phaser solenoid valves 202 are also coupled to the second cylinder head cover 34. As previously discussed, the cylinder head cover 34 defines a boundary of the cover enclosure 38 which is in fluidic communication with the crankcase chamber 40.

Figure 3:
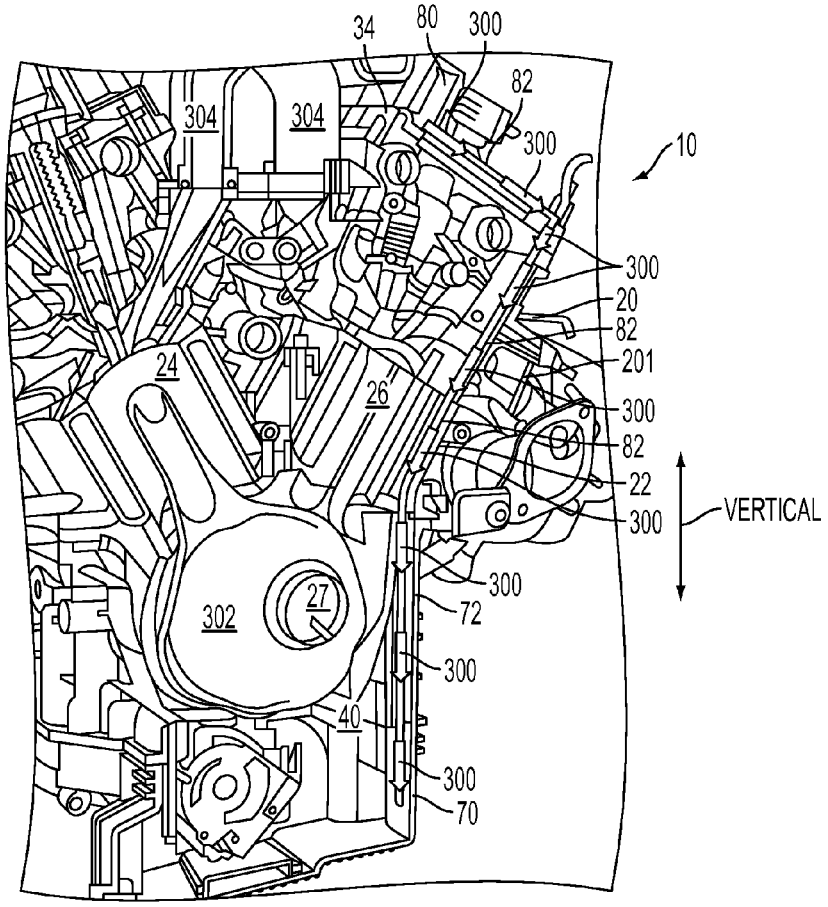

FIG. 3 shows a cross-sectional view of the engine 10 shown in FIG. 2. The oil return line 82 is shown in FIG. 3. Additionally, the oil separator 80 is shown coupled to the oil return line 82. The oil return line 82 extends through the cylinder head cover 34, the cylinder head 20, the cylinder block 22, the crankshaft girdle 72, and the oil reservoir 70. Arrows 300 depict the direction of oil flow through the oil return line 82. As shown, oil flows through the oil return line 82 into the oil reservoir 70. In this way, oil from the oil separator 80 may be returned to a lubrication system in the engine 10. As shown, the cylinder block 22 is coupled to the crankshaft girdle 72. Likewise, the crankshaft girdle 72 is coupled to the oil reservoir 70. Additionally, the cylinder head cover 34 is coupled to the cylinder head 20.

The cylinder 24 and the cylinder 26 are also shown in FIG. 3. A piston rod 302 coupled to the crankshaft 27 is also shown in FIG. 3. As previously discussed, the piston rods transfer energy generated in the cylinders to the crankshaft 27. The crankshaft 27 and the piston rods are positioned in the crankcase chamber 40, as discussed above with regard to FIG. 2.

Intake conduits 304 are also shown included in the engine 10. The intake conduits 304 are configured to provide intake air to the cylinders (24 and 26).

Figure 4:
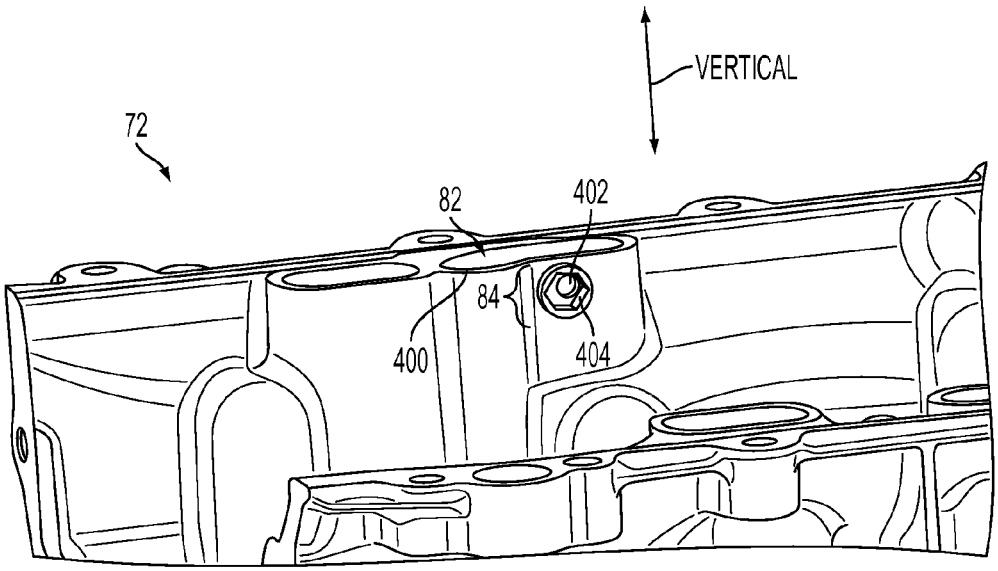
FIGS. 4-8 show different view of a crankshaft girdle included in the engine shown in FIGS. 2-3.

FIG. 4 shows the crankshaft girdle 72 included in the engine illustrated in FIGS. 2-3. A portion 400 of the oil return line 82 is shown in FIG. 4. The crankshaft girdle 72 includes the PCV bypass valve 84 integrated therein. Specifically, the PCV bypass valve 84 is positioned in a wall 400 of the oil return line 82. In the depicted example, the wall 400 is positioned in the crankshaft girdle 72. However, in other examples the wall 400 may be positioned in the cylinder block 22, the cylinder head 20, or the second cylinder head cover 34 (e.g., cam cover). When the PCV bypass valve 84 is positioned in the wall 400 the compactness of the PCV system is increased.

The PCV bypass valve 84, shown in FIG. 4 is positioned vertically below the integrated exhaust manifold 201 and the cylinder (24 and 26), shown in FIG. 3. A vertical axis is provided in FIGS. 3 and 4 for reference. Additionally, the PCV bypass valve 84 is positioned vertically above the crankshaft 27, shown in FIG. 3.

Continuing with FIG. 4, the PCV bypass valve 84 is a flapper valve in the example depicted in FIG. 4. The flapper valve includes a flapper 402 and a hexagonal portion 404. The hexagonal portion 404 enables the valve to be removed from the wall 400. In this way, the PCV bypass valve 84 may be removably coupled to the wall 400. In some examples, a hexagonal wrench may be used to remove the PCV bypass valve 84. It will be appreciated that other types of PCV bypass valves have been contemplated such as a check valve, etc., in other examples.

The PCV bypass valve 84 is configured to open when a pressure in the crankcase chamber exceeds a threshold value and close when a pressure in the crankcase chamber falls below a threshold value. The threshold values may be predetermined and/or equivalent. In this way, the likelihood of component damage caused by an over-pressurized crankcase chamber is reduced. As previously discussed, a portion of the boundary of the crankcase chamber may be defined by the crankshaft girdle 72. Various features or characteristics of the PCV bypass valve may be tuned to achieve this functionality. For instance, when a flapper valve is used the elasticity of the flapper may be adjusted to achieve a desired opening threshold pressure. When the PCV bypass valve 84 is open blow-by gas from the crankcase chamber flows into the oil return line 82 which travels to the oil separator and ultimately to the intake system.

Figure 5:
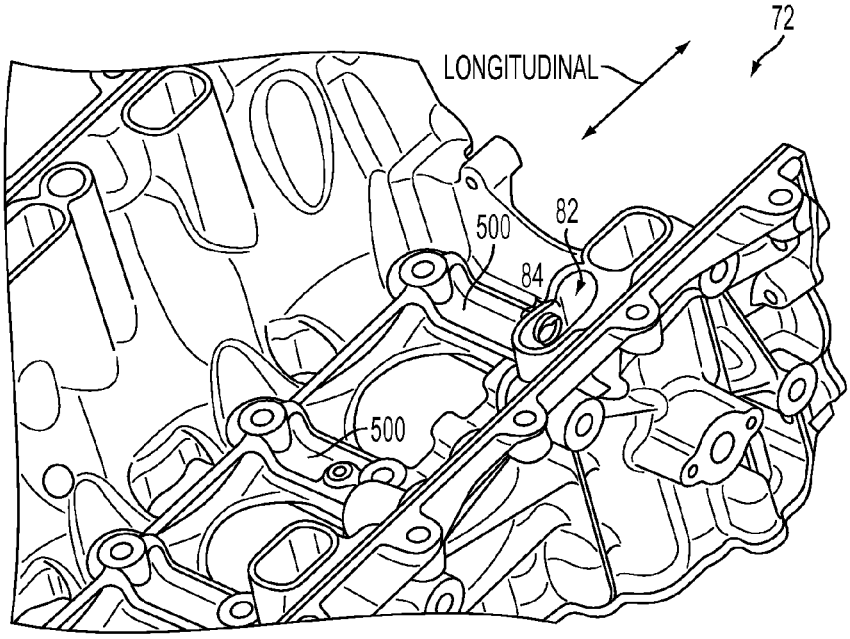

FIG. 5 shows another view of the crankshaft girdle 72 shown in FIG. 4 including the PCV bypass valve 84. Again, the oil return line 82 including the wall 400 is illustrated. It will be appreciated that the oil return line 82 is in fluidic communication with the oil separator 80, shown in FIG. 2. The PCV bypass valve 84 is positioned longitudinally between two cross-braces 500 in the crankshaft girdle 72. A longitudinal axis is provided for reference. The cross-braces 500 may be coupled to the oil reservoir 70 shown in FIG. 3. The cross-braces 500 provide support to the crankshaft 27, shown in FIG. 3.

Figure 6:
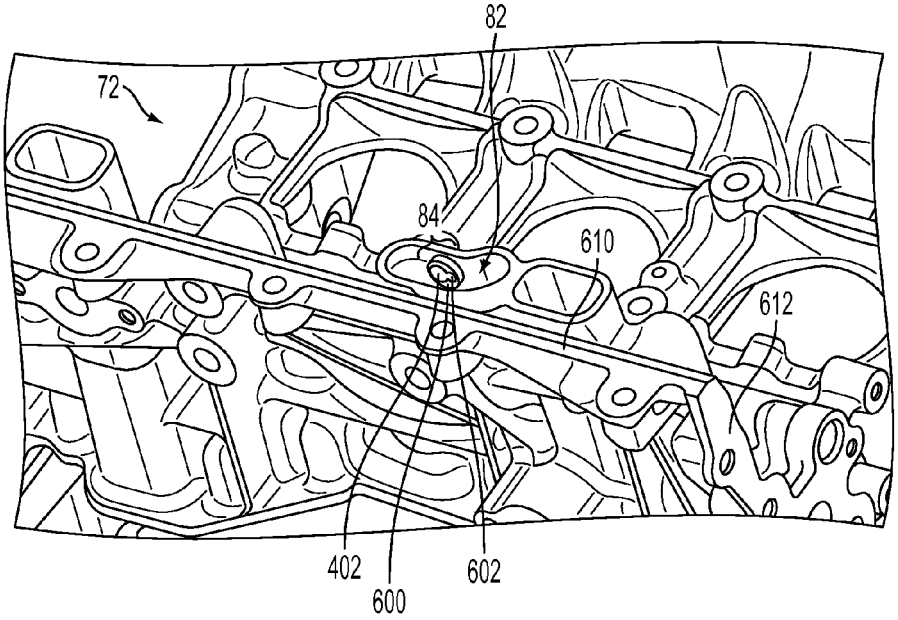

FIG. 6 shows another view of the crankshaft girdle 72 shown in FIG. 4 including the PCV bypass valve 84 and the oil return line 82. As shown, the flapper 402 is coupled to a valve housing 600 at point 602. As shown, the PCV bypass valve 84 is positioned adjacent to a cylinder block attachment surface 610. Additionally, the PCV bypass valve 84 is positioned near a transmission attachment surface 612.

Figure 7:
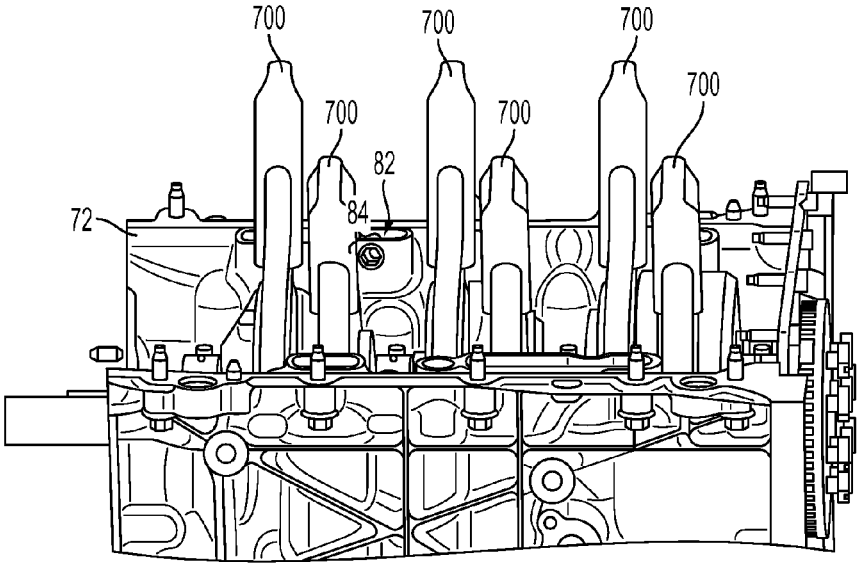

FIG. 7 shows another view of the crankshaft girdle 74 as well as piston rods 700. As previously discussed the piston rods 700 mechanically couple pistons to the crankshaft 27, shown in FIG. 3. Again, the PCV bypass valve 84 and the oil return line 82 are shown. The PCV bypass valve 84 is positioned between two of the piston rods 700, in the depicted example. Specifically, the PCV bypass valve 84 is positioned longitudinally between two piston rods (710 and 712) corresponding to cylinders in separate cylinder banks. A longitudinal axis is provided for reference. Additionally, the PCV bypass valve 84 is longitudinally positioned between two crankshaft bearing caps (714 and 716). The crankshaft bearing caps may house crankshaft bearings. However, other PCV bypass valve positions have been contemplated.

Figure 8:
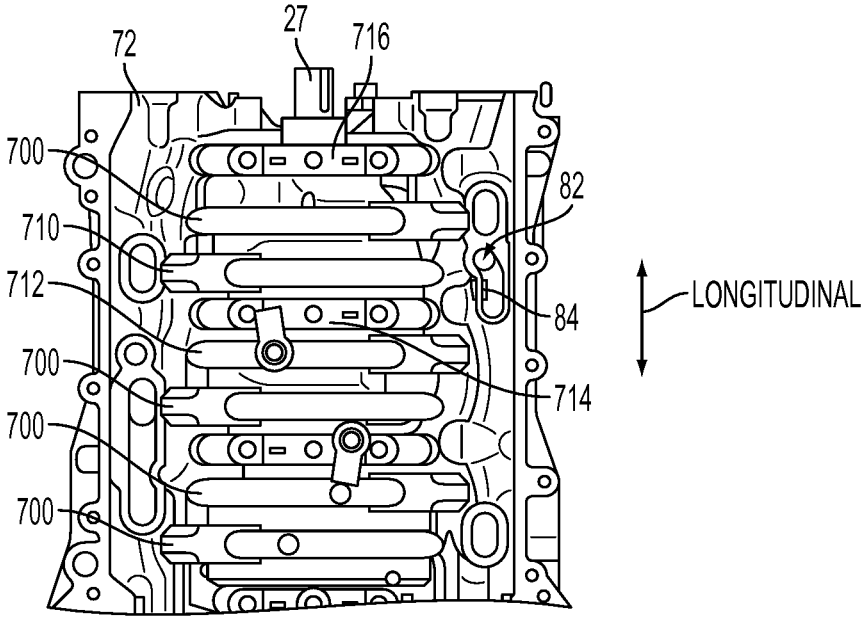

FIG. 8 shows a top view of the crankshaft girdle 74 and the piston rods 700. The PCV bypass valve 84 and the oil return line 82 are also shown in FIG. 8. The crankshaft 27 is also shown in FIG. 8.

Figure 9:
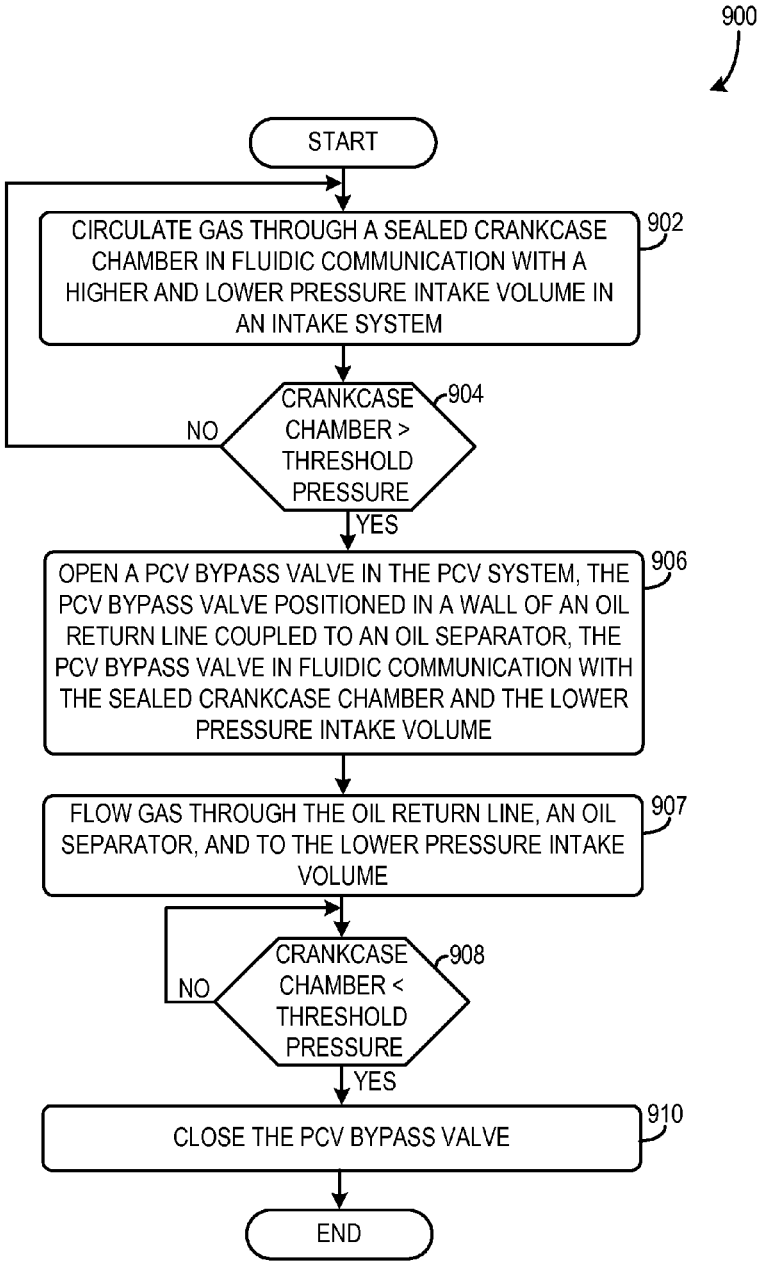
FIG. 9 shows a method for operating a PCV system.

FIG. 9 shows a method 900 for operating a PCV system. The method 900 may be implemented by the PCV system and components discussed above with regard to FIGS. 1-8 or may be implemented via other suitable PCV systems and components.

At 902 the method includes circulating gas through a sealed crankcase chamber in fluidic communication with a higher and lower pressure intake volume in an intake system. Next at 904 it is determined if a crankcase chamber pressure is greater than a threshold value. If the crankcase chamber pressure is not greater than the threshold value (NO at 904) the method returns to 902. However, if the crankcase chamber pressure is greater than the threshold value (YES at 904) the method proceeds to 906. At 906 the method includes opening a PCV bypass valve in the PCV system, the PCV bypass valve positioned in a wall of an oil return line coupled to an oil separator, the PCV bypass valve in fluidic communication with the sealed crankcase chamber and the lower pressure intake volume. Next at 907 the method includes flowing gas through the oil return line, an oil separator, and to the lower pressure intake volume.

At 908 it is determined if a crankcase chamber pressure is less than a threshold value. In some examples, the threshold values in steps 904 and 908 are substantially equivalent. However, in other examples the threshold values may not be equivalent. If it is determined that the crankcase chamber pressure is not less than the threshold value (NO at 908) the method returns to 908. However, if it is determined that the crankcase chamber pressure is less than the threshold value (YES at 908) the method proceeds to 910. At 910 the method includes closing the PCV bypass valve.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and methods disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A positive crankcase ventilation (PCV) system comprising an internal pathway through a cover enclosure for blow-by gases flowing from the crankcase to a PCV oil separator:

an oil return line coupled to the PCV oil separator and extending through a crankcase housing away from the PCV oil separator; and a PCV bypass valve positioned in a wall of the oil return line, downstream of the oil separator with regard to oil flow, and in direct fluidic communication with a sealed crankcase chamber and the oil return line, the PCV bypass valve opening when a crankcase chamber pressure exceeds a threshold value and closing when the crankcase chamber pressure falls below another threshold value the PCV bypass valve in an open position allowing at least a portion of the blow-by gases to flow to the PCV oil separator via the oil return line, thus at least a portion of the blow-by gases bypassing the internal pathway.

2. The PCV system of claim 1, where the wall of the oil return line is positioned in a cam cover.

3. The PCV system of claim 1, where the wall of the oil return line is positioned in a cylinder head.

4. The PCV system of claim 1, where the wall of the oil return line is positioned in a cylinder block.

5. The PCV system of claim 1, where the wall of the oil return line is positioned in a crankshaft girdle coupled to a cylinder block.

6. The PCV system of claim 1, where the PCV bypass valve is positioned below a cylinder.

7. The PCV system of claim 1, where the PCV bypass valve is positioned vertically above a crankshaft.

8. The PCV system of claim 1, where the PCV bypass valve is positioned between two piston rods.

9. The PCV system of claim 1, where the PCV bypass valve is in fluidic communication with an intake conduit.

10. The PCV system of claim 1, where the threshold values are equivalent.

11. The PCV system of claim 10, where the threshold values are pre-set.

12. The PCV system of claim 1, where the PCV bypass valve is a flapper valve.

13. The PCV system of claim 1, where the PCV bypass valve is removably coupled to the wall.

14. A method for operating a positive crankcase ventilation (PCV) system, comprising:

circulating blow-by gas through a sealed crankcase chamber in fluidic communication with a higher and lower pressure intake volume in an intake system via an internal pathway which allows the blow-by gas to flow from the crankcase to a cover enclosure and from there to the intake system; and when a crankcase chamber pressure exceeds a threshold value, opening a PCV bypass valve in the PCV system, the PCV bypass valve positioned in a wall of an oil return line coupled to an oil separator, downstream of the oil separator with regard to oil flow, and extending through a crankcase housing away from the oil separator, the PCV bypass valve in direct fluidic communication with the sealed crankcase chamber and in fluidic communication with the lower pressure intake volume, the PCV bypass valve in an open position allowing at least a portion of the blow-by gases to flow to the PCV oil separator via the oil return line, thus at least a portion of the blow-by gases bypassing the internal pathway.

15. The method of claim 14, where the higher pressure intake volume is positioned upstream of a throttle and the lower pressure intake volume is positioned downstream of the throttle.

16. The method of claim 14, further comprising flowing gas through the oil return line, the oil separator, and to the lower pressure intake volume.

17. The method of claim 14, further comprising closing the PCV bypass valve when the crankcase chamber pressure falls below a threshold value.

18. A positive crankcase ventilation (PCV) system comprising an internal pathway through a cover enclosure for blow-by gases flowing from the crankcase to a PCV oil separator:

an oil return line opening into an oil reservoir, coupled to the oil separator, and extending through a crankcase housing away from the oil separator; and a PCV bypass valve positioned in a wall of the oil return line downstream of the oil separator with regard to oil flow and in fluidic communication with an intake conduit and in direct fluidic communication with a sealed crankcase chamber, the PCV bypass valve opening when a pressure in the crankcase chamber exceeds a threshold value, the wall of the oil return line positioned in a crankshaft girdle coupled to a cylinder block, the PCV bypass valve in an open position allowing at least a portion of the blow-by gases to flow to the PCV oil separator via the oil return line, thus at least a portion of the blow-by gases bypassing the internal pathway.

19. The PCV system of claim 18, where the PCV bypass valve is a flapper valve.

20. The PCV system of claim 18, where the intake conduit is downstream of a throttle.

* * * * *